US005501181A

United States Patent [19]

Phelps, Sr.

[11] Patent Number: 5,501,181

[45] Date of Patent: Mar. 26, 1996

[54] SPIRAL FURNACE SUPPORT TUBE STRAP

[75] Inventor: Calvin E. Phelps, Sr., Akron, Ohio

[73] Assignee: The Babcock & Wilcox Company, New Orleans, La.

[21] Appl. No.: 302,563

[22] Filed: Sep. 8, 1994

[51] Int. Cl.[6] ..... F22B 37/00

[52] U.S. Cl. ..... 122/6 A; 122/235.12; 122/265; 122/510; 122/DIG. 14

[58] Field of Search ..... 122/6 A, 235.11, 122/235.12, 235.15, 235.22, 265, 510, 511, DIG. 14

[56] References Cited

U.S. PATENT DOCUMENTS

| | | | |
|---|---|---|---|
| 876,478 | 1/1908 | Mosher | 122/DIG. 14 |
| 2,248,890 | 7/1941 | Murray | 122/6 A |
| 3,637,008 | 1/1972 | Michel et al. | 122/510 |
| 4,524,727 | 6/1985 | Ammann | 122/235.12 |
| 4,770,128 | 9/1988 | McDonald et al. | 122/6 A |
| 5,033,542 | 7/1991 | Jabs | 122/510 |

*Primary Examiner*—Weilun Lo

*Attorney, Agent, or Firm*—Robert J. Edwards; Michael L. Hoelter

[57] ABSTRACT

A method of supporting the spiral boiler tubing that surrounds a portion of the furnace or combustion area of a steam generator. This method of support eliminates the need to weld plate to the outside of the boiler tubing thereby increasing the mass of the boiler tubing which will result in the creation of temperature differentials within the spiral tubing. In accordance with this invention, a plurality of support members are inserted within and alongside the regular spiral tubing forming a part of the furnace enclosure. These support members are periodically removed from within the plane of this furnace enclosure and re-positioned to another (usually more elevated) position within the furnace enclosure. As the support members near the top of the spiral tubing (which is also the transition from the spiral tubing to more vertically aligned tubing), these support members are secured to this vertical tubing thereby transferring the loading of the spiral tubing to the vertical tubing. In other embodiments, it may be desirable to transfer the loading to other support members such as boiler top support steel.

8 Claims, 1 Drawing Sheet

SPIRAL FURNACE SUPPORT TUBE STRAP

FIELD OF THE INVENTION

The invention pertains in general to a support mechanism for steam boilers and more particularly to a means of supporting the boiler tubes of a spiral furnace steam generator.

BACKGROUND OF THE INVENTION

Generally, the furnace or combustion area of a steam generator is enclosed either solely by vertical boiler tubing or it is enclosed by a combination of spiral and vertical boiler tubing. As is well known, vertical boiler tubing is generally self-supporting while spiral boiler tubing requires extensive exterior support. This is because vertical boiler tubing must generally only withstand tensile or compressive forces in one direction along its vertical "Y" axis (in addition to its internal pressure forces) and thus need only be supported against buckling. In contrast, spiral boiler tubing must carry its load in three directions (along the "X", "Y", and "Z" axis) as it ascends in a spiral manner around the furnace or combustion area. Such spiral boiler tubing is thus subject to tension, compression, shear, moment, torsion, and hoop forces in addition to its internal pressure forces.

Despite such structural drawbacks, spiral boiler tubing has an operational advantage over vertical boiler tubing since it provides parallel flow paths around the combustion chamber enabling each tube to pass through very similar zones of heat input intensities. This enables the fluid contained within each spiral boiler tube to absorb nearly the same amount of heat from the different heat zones within the combustion chamber. In contrast, vertical boiler tubing provides vertically parallel flow paths with the fluid contained therein absorbing considerably different amounts of heat from fewer different heat zones within the combustion chamber. Consequently, the fluid flow heat balance between adjacent tubes, or from tube to tube, is inherently better with spiral tubing than with vertical tubing, especially at subcritical pressures. This is especially advantageous for once-through steam generators.

In the past, spiral boiler tubing was held or supported in place by using plates that were welded to the outside of the tubing. These plates themselves were then secured to structural members that, in turn, transferred the load to other supporting structure located either above or below the spiral tubing, such loads oftentimes included some of the burner and windbox loads as well. When the spiral tubing was supported from above, such loads were secured to either the upper vertical boiler tubing or to upper boiler support steel. When the spiral tubing was supported from below, such loads were transmitted to the foundation via adjacent structural members and spring type supports.

One method of supporting the spiral tubing from upper vertical tubing involves a plurality of plate-type straps. These straps would be continuously welded to the outside of the spiral tubing in a vertical direction. Generally, these straps would extend across the spiral tubing section of the furnace enclosure from the lower furnace hopper to the upper vertical tubing. Upon reaching the upper vertical tubing, the straps would be paddled with multiple fingers in an attempt to evenly distribute such loading amongst the vertical tubing. In this fashion, the loading of the underneath spiral tubing would be transferred to the upper vertical tubing.

As is well known, it is quite common for steam generators to operate at variable furnace pressures or for them to frequently cycle between being on-line and off-line. While these generators can be designed for such variations, such designs can accommodate only a finite number of such cycles before they fail. Consequently, securing any type of welded plate to the outside of the furnace enclosure will impact upon the designed life span of the generator by adding to the already existing stresses and strains of the spiral tubing. Such additional positive and negative thermal stresses will cause or contribute to increased fatigue damage, more pressure part failures, reduced life expectancy of the tubing, enhanced potential for outages, and greater need for corrective maintenance and repair.

It is thus an object of this invention to provide a means of supporting spiral tubing that does not rely upon the use of external support plates welded or otherwise secured to the tubing. A further object of this invention is to provide a means of more evenly dispersing the loading of the spiral tubing onto the upper vertical tubing if this is desired. Another object of this invention is to provide a means of concentrating the loading of the spiral tubing into a few select locations for subsequent transfer elsewhere if so desired. Yet another object of this invention is to provide a means of support that is economical to both construct and install. Still another object of this invention is to provide a means of supporting the spiral tubing that will not cause or create additional temperature differentials within the tubing. Another object of this invention is to provide a means of supporting the spiral tubing without compromising the designed life expectancy of the generator, its tubing, or its various components. Yet another object of this invention is to support such spiral tubing without increasing the occurrence of fatigue damage. These and other objects and advantages will become obvious upon further investigation.

SUMMARY OF THE INVENTION

A method of supporting the spiral boiler tubing that surrounds a portion of the furnace or combustion area of a steam generator. This method consists of the steps of securing a plurality of elongated support members parallel to and co-planer with a series of upwardly spiraling elongated tubular members. These upwardly spiraling elongated tubular members are formed or configured to surround a portion of the furnace or combustion area of the steam generator. The combination of these support members and tubular members define a spiral tubular furnace enclosure. Periodically, a first support member is removed from within the spiral tubular furnace enclosure at a first location and re-positioned to a second location within the spiral tubular furnace enclosure. Furthermore, a second support member is inserted within the spiral tubular furnace enclosure at this first location where the first support member was removed from the spiral tubular furnace enclosure. Finally, these support members are secured to an upper region of the steam generator.

DETAILED DESCRIPTION OF THE DRAWING

Figure 1:
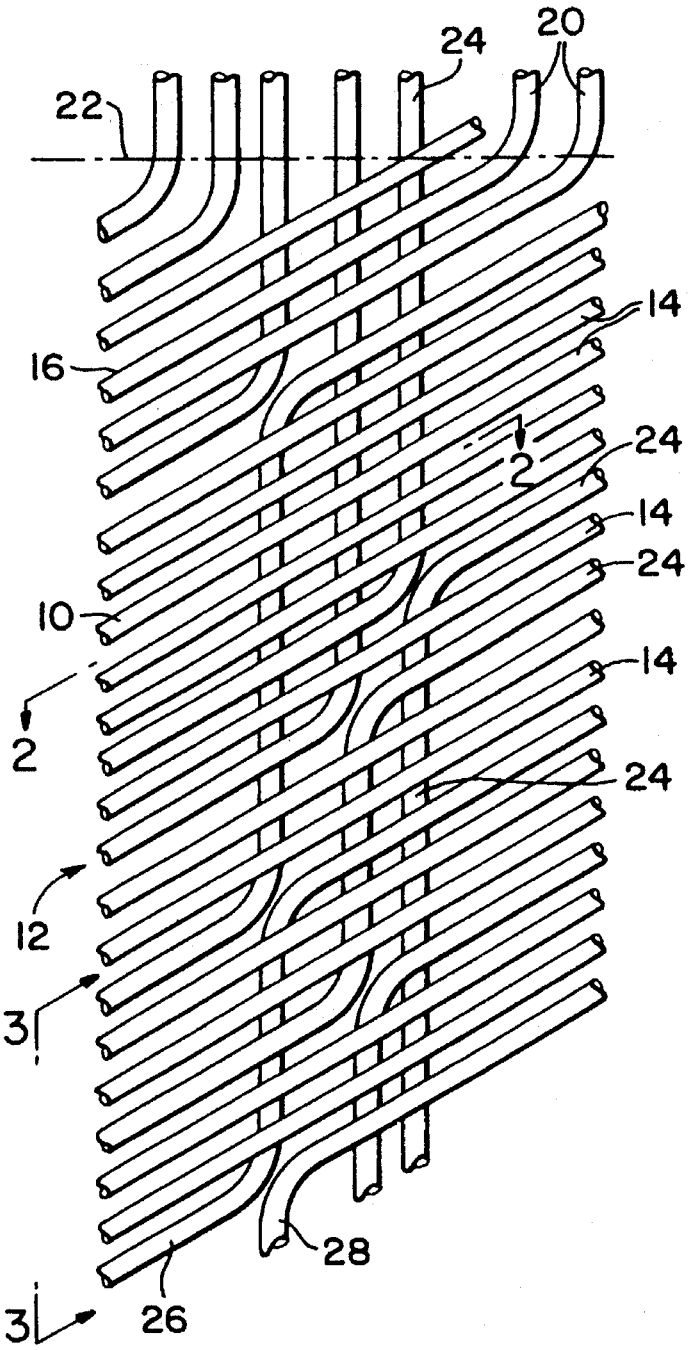
FIG. 1 is a pictorial view, partially cut away, of one section of the inside (hot) surface of spiral tubing that surrounds the furnace enclosure.

Referring initially to the drawings, there is shown the inside (hot) surface of elongated spiral tubing 10 which generally surrounds a lower portion of the furnace or combustion area of steam generator 12. As illustrated, tubing 10 consists of a series of parallel, upwardly spiraling boiler tubes 14. These individual boiler tubes 14 are usually prefabricated into a tubular furnace enclosure 16 by welding or otherwise affixing elongated bars 18 to intermediate adjacent boiler tubes 14. In this fashion, the resulting tubular furnace enclosure 16 will be impervious to the flue gases generated within the furnace or combustion area of steam generator 12.

Also illustrated in FIG. 1 is a small section of vertical boiler tubing 20 located above spiral tubing 10. The transition between lower spiral tubing 10 and upper vertical tubing 20 is shown at 22.

During the construction of tubular furnace enclosure 16, a plurality of elongated support members 24 will be inserted among the various boiler tubes 14. These support members 24 will extend alongside normal boiler tubes 14 and will have the same or nearly the same mass as tubes 14. In some cases, support members 24 can actually be a boiler tube 14 that will not be used for heat exchange purposes (i.e. support members 24 are on the outside of the furnace for a short distance and will not be absorbing heat directly form the combustion process). Support members 24 will be secured to the furnace enclosure 16 in the normal fashion via bars 18 and may be indistinguishable from adjacent boiler tubes 14 upon initial glance.

Figure 2:
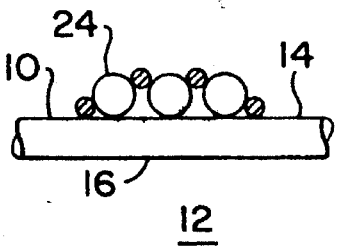
FIG. 2 is a sectional view, partially cut away, taken along lines 2—2 of FIG. 1.
Figure 3:
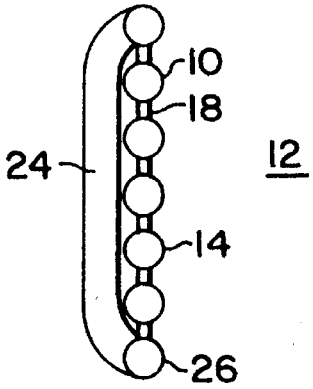
FIG. 3 is a sectional view, partially cut away, taken along lines 3—3 of FIG. 1.
Figure 4:
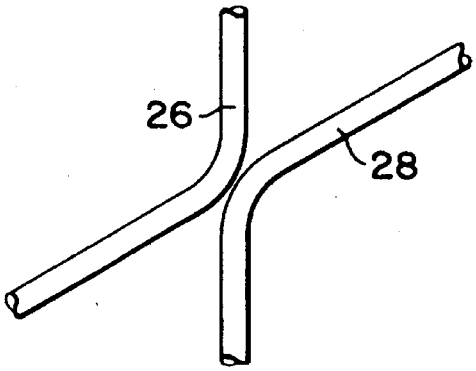
FIG. 4 is an enlarged pictorial view, partially cut away, of a detail of FIG. 1.

The difference between support members 24 and normal adjacent boiler tubes 14 will be that periodically, one or more support members 24 will be lifted out of its planar position within tubular furnace enclosure 16 and vertically relocated to another position within furnace enclosure 16 (see FIGS. 2 and 3). When this occurs, a support member 24 from a lower position within tubular furnace enclosure 16 will be inserted within furnace enclosure 16 at the point the first support member 24 was removed from furnace enclosure 16. FIG. 4 illustrates support member 26 being removed from a specific location of furnace enclosure 16 while support member 28 is inserted at this location as a substitute therefor. This interchange maintains the parallelism of adjacent boiler tubes 14 within furnace enclosure 16 thereby also maintaining the slope of spiral tubing 10.

When such a support member 24 is removed from its planar position within furnace enclosure 16, this support member 24 generally travels vertically upward behind adjacent boiler tubes 14 (i.e. along the "cold" side of tubes 14 and away from the inside or "hot" surface of steam generator 12). FIGS. 1 and 2 illustrate three such support members 24 being removed at a given elevation and travelling upward together along parallel paths. At other locations, more or fewer such support members 24 may travel upward together. It is also possible for the adjacent support members 24 travelling upward together to be welded or otherwise secured together as shown in FIG. 2 for additional strength. FIG. 2 also illustrates such support members 24 being welded or secured to the boiler tubes 14 they cross.

At the bottommost elevation of spiral tubing 10, whenever a built-in support member 24 is removed and relocated to a higher position as indicated above, a "filler" tube or member (not shown) can be inserted within furnace enclosure 16 where such support member 24 was removed so as to also maintain the slope and spacing of spiral tubing 10.

At or near transition 20, the vertically extending support members 24 from spiral tubing 10 will be welded or otherwise secured to vertical boiler tubing 20. In this fashion, the loading of spiral tubing 10 will be transferred to vertical boiler tubing 20 without the need for any external supports or welded plates normally required to transfer such loading. This "weaving" of support members 24 into vertical boiler tubing 20 can be evenly dispersed along transition 20 so that the load from spiral tubing 10 is uniformly disseminated among vertical tubing 20. In other cases, it may be preferred for support members 24 to concentrate or congregate together at certain locations where they will then be secured to vertical tubing 20 or other structure. This arrangement may be preferable when it is desired to concentrate the loading of spiral tubing 10 at a few selected locations rather than evenly disperse such loading along transition 22 and amongst vertical boiler tubing 20.

By transferring the loading from spiral tubing 10 in the manner described above, the life span of the furnace is not reduced since there is no significant change in the mass of the furnace enclosure which would result in the creation of additional temperature differentials. Furthermore, by supporting spiral tubing 10 in this fashion, a greater design flexibility of steam generator 12 is possible since there will now be more choices and control as to where, when, and how much such loading is to be transferred to either upper vertical boiler tubing 20 or top boiler support steel. Also, the construction of such a steam generator 12 will be more economical since the previous need to weld flat plate to the outside of spiral tubing 10 is now eliminated. Additionally, since the above method of support will not create additional temperature differentials within spiral tubing 10 nor interfere with the design life expectancy of the generator, the steam generator may now be rapidly cycled or variably operated without any additional adverse effects on the generator. Consequently, the generator can now be cycled on-off as needed, operated through load changes more rapidly and started up and shut down more quickly since the operators need no longer accommodate or consider the inherent limitations associated with the earlier methods of supporting spiral tubing 10. The result of this invention will be a substantial improvement in plant reliability and availability and also a substantial reduction in plant operating costs.

What is claimed is:

1. A method of supporting the spiral boiler tubing that surrounds a portion of the furnace or combustion area of a steam generator comprising the steps of:

(a) securing a plurality of elongated support members parallel to and co-planer with a series of upwardly spiraling elongated tubular members, said upwardly spiraling elongated tubular members formed or configured to surround a portion of the furnace or combustion area of the steam generator, the combination of said support members and said tubular members defining a spiral tubular furnace enclosure;

(b) removing a first said support member from within said spiral tubular furnace enclosure at a first location and re-positioning said first support member to a second location within said spiral tubular furnace enclosure;

(c) inserting a second said support member within said spiral tubular furnace enclosure at said first location where said first support member was removed from said spiral tubular furnace enclosure; and, (d) securing said support members to an upper region of the steam generator.

2. The method as set forth in claim 1 further comprising the step of re-positioning said first support member to a higher or upper elevation of said spiral tubular furnace enclosure.

3. The method as set forth in claim 2 further comprising the step of inserting said second support member at an elevation above the elevation from which said second support member was removed from said spiral tubular furnace enclosure.

4. The method as set forth in claim 3 further comprising the step of vertically re-positioning said support members.

5. The method as set forth in claim 4 further comprising the step of constructing and arranging said support members as tubes.

6. The method as set forth in claim 5 further comprising the step of securing said support members to upper vertically aligned tubular members that also surround a portion of the furnace or combustion area of the steam generator.

7. The method as set forth in claim 6 further comprising the step of extending said support members across the transition from said spiral tubular furnace enclosure to said vertically aligned tubular members.

8. The method as set forth in claim 5 further comprising the step of securing said support members to boiler top support steel.

* * * * *